US006124514A

United States Patent [19]

Emmrich et al.

[11] Patent Number: 6,124,514

[45] **Date of Patent: *Sep. 26, 2000**

[54] PROCESS FOR GENERATING PURE BENZENE FROM REFORMED GASOLINE

[75] Inventors: Gerd Emmrich, Essen; Hans-Christoph Schneider, Hattingen; Helmut Gehrke; Bernhard Firnhaber, both of Essen, all of Germany

[73] Assignee: Krupp Uhde GmbH, Dortmund, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/791,893

[22] Filed: Jan. 31, 1997

[30] Foreign Application Priority Data

Feb. 3, 1996 [DE] Germany ..... 196 03 901

[51] Int. Cl.[7] ..... C07C 5/02

[52] U.S. Cl. ..... 585/261; 208/96; 208/100; 208/62; 208/66; 208/143; 208/144; 585/833; 585/259; 585/264; 585/260

[58] Field of Search ..... 208/96, 100, 62, 208/66, 143, 144; 585/833, 259, 264, 260, 261

[56] References Cited

U.S. PATENT DOCUMENTS

| | | | |
|---|---|---|---|
| 2,084,471 | 6/1937 | Whiteley, Jr. | 208/323 |
| 2,960,548 | 11/1960 | Ayers et al. | 585/866 |
| 3,044,950 | 7/1962 | Swartz, Jr. | 208/57 |
| 3,316,318 | 4/1967 | Voetter et al. | 260/674 |
| 3,514,395 | 5/1970 | McVay et al. | 208/96 |
| 3,865,716 | 2/1975 | Sosnowski | 208/255 |
| 3,899,412 | 8/1975 | Rowe et al. | 208/92 |
| 3,992,465 | 11/1976 | Juguin et al. | 260/668 D |
| 4,503,267 | 3/1985 | Pavlin | 568/753 |
| 4,781,820 | 11/1988 | Forte | 208/333 |
| 5,139,651 | 8/1992 | Forte | 208/334 |
| 5,191,152 | 3/1993 | Forte | 585/833 |
| 5,202,520 | 4/1993 | Forte | 585/808 |
| 5,225,072 | 7/1993 | Vidueira | 208/313 |
| 5,310,480 | 5/1994 | Vidueira | 208/313 |
| 5,336,840 | 8/1994 | Forte | 585/833 |
| 5,685,972 | 11/1997 | Timken et al. | 208/89 |
| 5,817,227 | 10/1998 | Mikitenko et al. | 208/143 |

*Primary Examiner*—Walter D. Griffin
*Assistant Examiner*—Nadine Preisch
*Attorney, Agent, or Firm*—Herbert Dubno; Jonathan Myers

[57] ABSTRACT

A process is disclosed for generating pure aromatic compounds from a reformed gasoline which contains aromatic compounds, olefins, diolefin, and triolefins, which comprises the steps of:

(a) selectively hydrogenating the olefins, diolefins and triolefins in the reformed gasoline to obtain a mixture of hydrogenated, non-aromatic compounds and aromatic compounds; and (b) separating the aromatic compounds from the hydrogenated, non-aromatic compounds in the mixture formed during step (a) by either extractive distillation, liquid—liquid extraction or both to obtain the pure aromatic compounds.

9 Claims, 2 Drawing Sheets

PROCESS FOR GENERATING PURE BENZENE FROM REFORMED GASOLINE

FIELD OF THE INVENTION

This invention relates to a process for generating pure aromatics from reformed gasoline. The invention relates further to an apparatus for carrying out the process.

BACKGROUND OF THE INVENTION

Reformed gasoline is an aromatics-rich gasoline, which is produced by reforming, particularly by catalytic reforming of crude oil fractions. During the reforming process, isomerizations, rearrangements, cyclizations, dehydrogenations and similar reactions take place in the alkanes and cycloalkanes contained in the petroleum or crude oil. The aromatics-rich reformed gasoline produced by catalytic reforming is an important base material for the production of aromatic compounds.

Aromatic compounds, in particular benzene, toluene, xylene and ethylbenzene are important base materials for the chemical industry, especially for the manufacture of plastics and man-made fibers. Aromatic compounds are also used as octane enhancers in gasoline. Due to the increasing demand for aromatic compounds from the chemical industry, the reaction conditions and catalysts used for catalytic reforming of crude oil fractions are designed for a high aromatics yield. As a result, however, also a higher quantity of unsaturated non-aromatics and in particular olefins, are produced.

The chemical industry requires, however, mainly pure aromatics, i.e. aromatics containing the smallest possible amount of impurities of unsaturated non-aromatics. These impurities consisting of unsaturated non-aromatics could, until now, only be separated from the aromatics by complex physical and chemical separation processes, and generally a complete removal of the non-aromatics is impossible. Bromine index and acid wash color are used as measurements for the purity level of aromatics, in particular pure benzene, and thus provide a measurement of the content of unsaturated non-aromatic impurities. According to the requirements of the chemical industry, the bromine index of pure benzene should not exceed a value of 20 and the acid wash color should not exceed a value of 1.

In a known process for separating the aromatics from reformed gasoline, an extractive distillation or a liquid—liquid extraction is initially carried out on the aromatics-containing mixture. In order to achieve the aforementioned purity levels, the aromatic fractions generated by the extraction require, however, a complex secondary treatment. Normally a secondary treatment is carried out in which the fractions are either washed with concentrated sulfuric acid or are treated with bleaching earth. Both chemical secondary processes are complex and expensive. The reaction with bleaching earth is carried out at high temperatures causing polymers to be formed which remain attached to the bleaching earth. At the same time, oligomers, leading to a relatively high acid wash color, are formed from unsaturated olefinic non-aromatics. Subsequent to the treatment with bleaching earth, a complex and costly distillation separation of pure aromatics from non-aromatics is required.

OBJECTS OF THE INVENTION

An object of the invention is to provide a process for the generation of aromatic compounds having a high purity level where the process fulfills all industry requirements regarding levels of purity, especially bromine index and acid wash color.

A further object of the invention is to provide a process that is simple, low cost and functionally reliable.

A further object is to provide an apparatus for carrying out the abovementioned process.

SUMMARY OF THE INVENTION

The invention provides a process for the generation of pure aromatics from reformed gasoline, in which the reformed gasoline is selectively hydrogenated in a first process stage, for which the hydrogenation conditions are set in such a way that mainly nonaromatics and in particular, olefins, diolefins and triolefins are hydrogenated, and in which subsequently in a second process stage, the selectively hydrogenated and aromatics-containing products from the first process stage are separated by extract distillation and/or liquid—liquid extraction into aromatics and non-aromatics.

Within the context of the invention, reformed gasoline refers also to mixtures containing reformed gasoline or reformed cuts or distillation cuts from reformed gasoline.

The invention is based on the knowledge that by combining the selective hydrogenation of unsaturated non-aromatics in the reformed gasoline, in particular olefins, diolefins and triolefins, with the extract distillation and/or liquid—liquid extraction of the product from the hydrogenation, aromatics with an extremely high purity level can be generated. The invention is furthermore based on the knowledge that in the aforementioned extraction process for generating pure aromatics, the high acid wash color of the extraction product is caused in particular by the olefins and that even an extremely low diolefin content causes a high acid wash color. In particular, it has been established that $C_6$-cyclodiene and $C_6$-diene and $C_6$-triene lead to a high acid wash color. This applies in particular to those aforementioned olefins, whose boiling points are near to the boiling point of benzene and which are consequently difficult to separate from benzene.

According to the invention, particularly those olefins are selectively hydrogenated in an hydrogenation stage preceding the extraction stage. Due to the combination of selected hydrogenation and subsequent extract distillation and/or liquid—liquid extraction according to the invention, aromatics are achieved, whose bromine index is below 20 and whose acid wash color is below 1. In this respect the pure aromatics generated by the procedure according to the invention fulfill all requirements of the chemical industry with regards to bromine index and acid wash color. At the same time the process is neither complex nor costly. Consequently this process offers considerable advantages compared to known processes.

According to a preferred embodiment of the inventive process, which is particularly significant within the context of the invention, a reformed cut, containing mainly benzene as the aromatic part, is used as reformed gasoline. For generating this reformed cut or distillation cut, a fractional distillation is carried out on the reformed gasoline prior to the selective hydrogenation so that the resulting reformed cut contains in principle only benzene as aromatics. This embodiment of the process according to the invention is characterized by the advantage that on the one hand separation of benzene from the reformed gasoline is achieved and on the other hand, pure benzene can be generated at the same time, which is of significant importance for the chemical industry. The removal of benzene from reformed gasoline that is further processed to automotive fuel, is important for health reasons and the reduction of benzene content in automotive fuel has become an increasingly important issue.

According to a further preferred embodiment of the invention, a reformed cut with aromatics of a selected carbon index $C_x$ or with aromatics of several, selected carbon indices $C_x$, $C_y$ . . . is used as reformed gasoline. Such a reformed cut or distillation cut is generated by fractional distillation from reformed gasoline, in which aromatics of other carbon indexes are mainly separated by distillation. According to a preferred feature, the reformed cut only contains aromatics of one carbon index, for instance $C_6$ or $C_8$ aromatics. According to a further preferred feature of the inventive process, the reformed cuts contain aromatics with two or three carbon indices whose boiling point is preferably close to that of benzene, toluene or xylene. The further preferred feature has the advantage that with regards to the bromine index and acid wash color, particularly pure aromatics can be generated.

Another feature of the process according to the invention, in which in a first process stage nickel or palladium on a carrier material is used as hydrogenating catalyst for the hydrogenation, has proven to be particularly successful. Preferably, nickel or palladium is used on an aluminum oxide carrier as hydrogenation catalyst. Within the context of the invention, however, also other hydrogenating catalysts can be used. The hydrogenating conditions for the selective hydrogenation are adjusted depending on the desired hydrogenation reaction and the desired hydrogenation conversion. Those skilled in the art will be able to adjust these conditions such as, pressure, temperature, catalyst composition, hydrogen/hydrocarbon ratio as well as throughput and bed volume in the hydrogenation reactor. Preferably, the selective hydrogenation is carried out in such a way, that in particular diolefins and triolefins are completely hydrogenated. According to a preferred feature of the inention, the hydrogenation conditions may be adjusted in such a way that conjugated diolefins and triolefins are fully hydrogenated. Preferably $C_6$-diene and $C_6$-triene and $C_6$-triolefins whose boiling point is similar to the boiling point of benzene and which are consequently difficult to separate from benzene are, if possible, fully hydrogenated by the selective hydrogenation.

After the hydrogenation, gaseous components are removed from the hydrogenation reactor and the liquid, selectively hydrogenated and aromatic hydrocarbons are passed together with still dissolved residual gases to the extract distillation and/or liquid—liquid extraction. For the extract distillation and the liquid—liquid extraction, normally a selective solvent is used as extraction agent for separating substances to be isolated from remaining substances. Within the context of the procedure according to the invention, the aromatics are dissolved in the used selective solvent, forming the extract with this solvent, while the non-aromatics are removed with the raffinate. The feature of the process according to the invention in which the extractive distillation and/or liquid—liquid extraction is preferably carried out with a selective solvent of the group N-formyl morpholine, N-methyl pyrrolidone, sulfolane, ethylene glycol or ethylene glycol derivatives. According to a preferred feature of the invention an N-substituted morpholine with 1 to 8 carbon atoms in the substituent is used as the selective solvent. Or alkandiols with 2 to 5 carbon atoms and/or their mono and/or dialkyl ether may be used as the selective solvent. Within the scope of the invention also mixtures of the said solvents may be used as selective solvent. Furthermore, also other solvents suitable as selective solvents for separating aromatics as part of extractions may be used. Also solvent/water mixtures may be used.

Withing the scope of the invention, mixtures from the selectively hydrogenated reformed gasoline and other hydrogenated aromatics-containing crude products and/or mixtures of distillation cuts of these crude products may be used in the second process stage, in which the extraction is carried out.

The pure aromatics are separated advantageously by distillation from the selective solvent after extract distillation and/or liquid—liquid extraction.

DETAILED DESCRIPTION OF THE DRAWINGS

Figure 1:
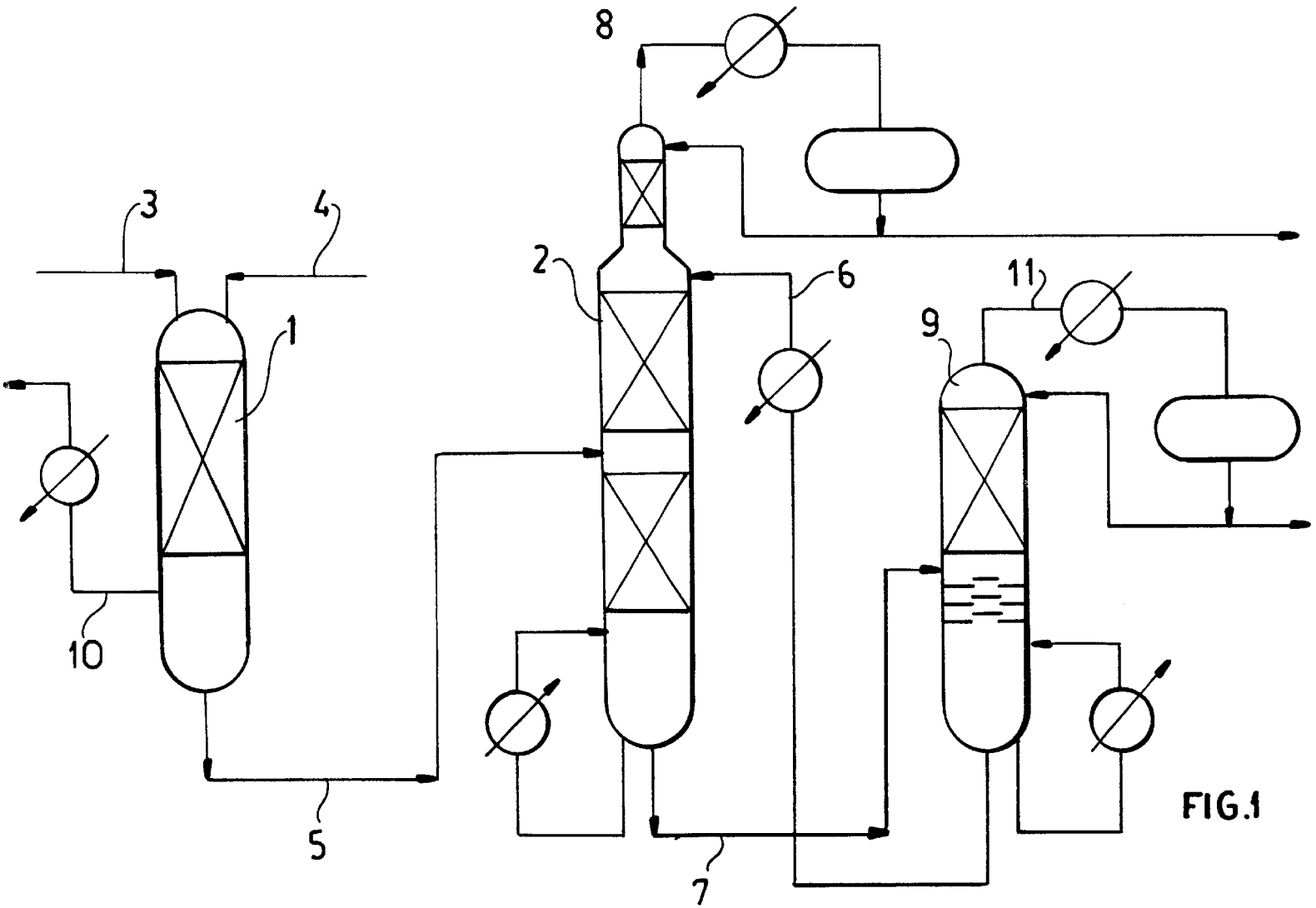
FIG. 1 is a schematic diagram of the process and apparatus according to the invention.

Below, the process according to the invention is explained with reference to the device for the implementation of this process shown in FIG. 1. FIG. 1 shows a device for implementing the process according to the invention, including a hydrogenation reactor 1 and a subsequent extraction unit 2. The hydrogenation reactor 1 contains a first feed pipe 3 supplying the reformed gasoline. A reformed cut generated by a fractional distillation from reformed gasoline passes through the feed pipe 3 into the hydrogenation reactor 1. The hydrogenation reactor 1 contains a second feed pipe 4, supplying hydrogen. The supply of hydrogen refers in the context of the invention also to the supply of a hydrogen-rich gas. The hydrogention reaction 1 contains furthermore a fixed bed consisting of hydrogenation catalyst. Preferably, and in the example, nickel or palladium on an aluminum oxide carrier are used as catalysts. The hydrogenation conditions for the selective hydrogenation, such as temperature, pressure, hydrogen/hydrocarbon ratio as well as throughput and bed volume in the hydrogenation reactor 1 are set, depending on the desired hydrogenation reaction and the desired hydrogenation conversion. Gaseous components leave the hydrogenation reactor 1 via discharge pipe 10. The liquid, selectively hydrogenated and aromatics-containing products from the selective hydrogenation leave the hydrogenation reactor 1 together with the still dissolved residual gases, via the connecting pipe 5.

The extraction unit 2 is connected to the hydrogenation reactor 1 via the connecting pipe 5 for the liquid, selectively hydrogenated and aromatic-containing products from the selective hydrogenation. According to FIG. 1, the extraction unit 2 is an extractive distillation column. As shown in FIG. 1 the product from the hydrogenation enters the central section of the extract distillation column via a connecting pipe 5. In the extract distillation column the aromatics are separated from the non-aromatics. For this purpose, the extraction unit 2 contains attached to its upper section a feed device 6 for a selective solvent. The selective solvent effects the distillation separation of non-aromatics and aromatics dissolved in the selective solvents (extract). For this purpose, the extraction unit 2 contains a first discharge pipe 7 for the extract from the selective solvent and aromatics. The extraction unit 2 also contains a second discharge pipe 8 for the raffinate and the non-aromatics.

According to FIG. 1, a distillation unit 9 for the distillation separation of selective solvents and pure aromatics is connected to the first discharge pipe 7. The selected solvent, removed by distillation in the distillation unit 9 is returned to the extract distillation column via feed device 6. The pure aromatics separated by distillation in the distillation unit 9 are discharged via the pure aromatics pipe 11 or are passed on for further utilization.

Figure 2:
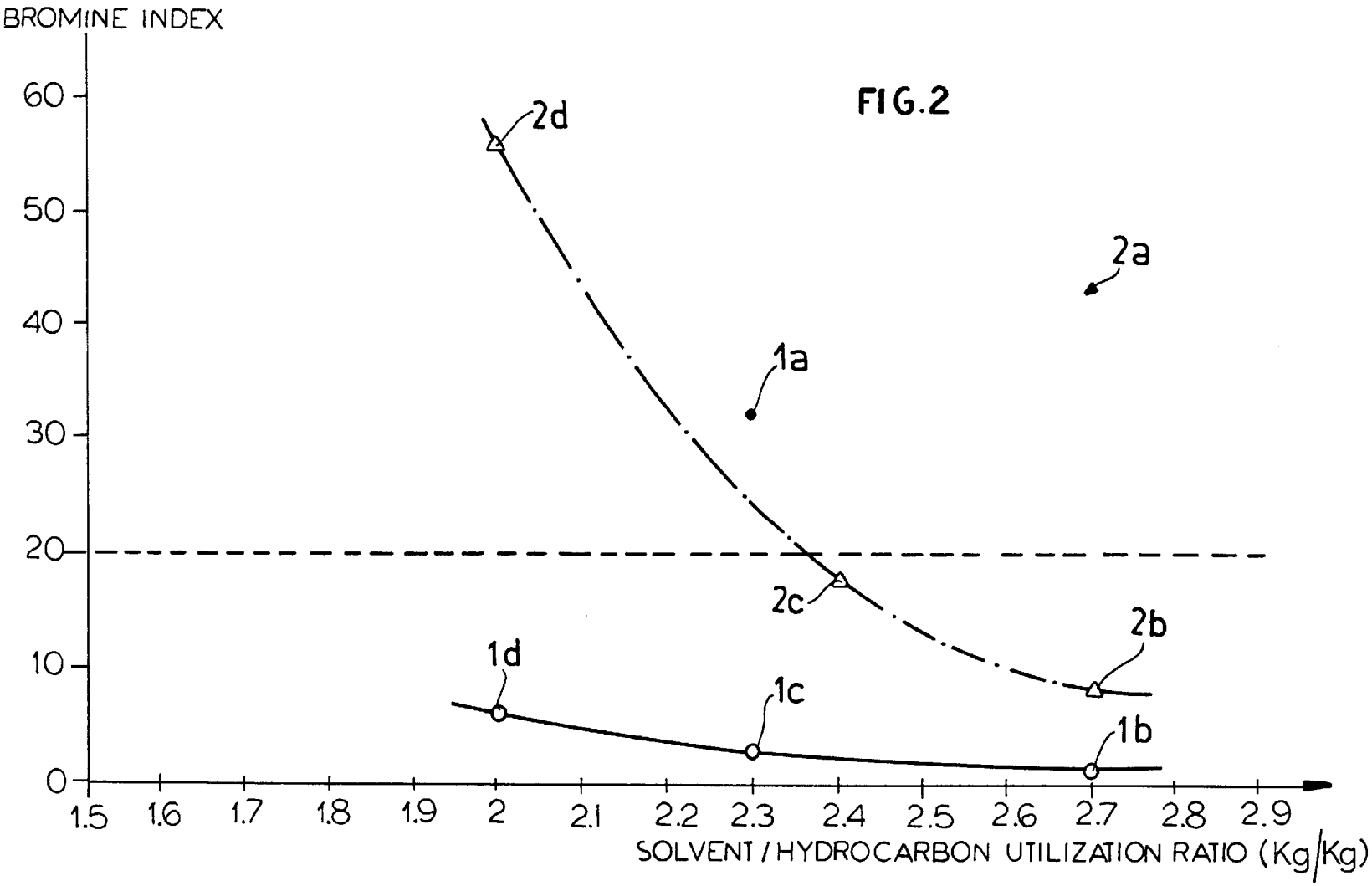
FIG. 2 is a graph where solvent/hydrocarbon utilization ratio is plotted against bromine index.

In FIG. 2, the bromine index of the pure benzene is shown as a function of the solvent/hc utilization ratio of the extractive distillation. The measuring point 1*a* shows the respective values from example 1a in table 2, for which no selective hydrogenation was used. The continuous curve shows the respective values of examples 1b to 1d of table 2, at which the selective hydrogenation was carried out in such a way that approx. 0.96% of the used benzene was hydrogenated to cyclohexane. The measuring point 2*a* represents the respective said example in table 3 without selective hydrogenation. The dotted line shows the examples 2b to 2d in table 3 in which the selective hydrogenation was carried out in such a way that only approx. 0.29% of the used benzene was hydrogenated to cyclohexane. The dotted line in FIG. 2 shows the limit 20 for the bromine index. FIG. 2 shows that by changing the hydrogenation conditions or the hydrogenation depths and changing the solvent/hc utilization ratio, the procedure can be varied depending on the desired result, i.e. according to the acceptable benzene loss on one hand and the desired bromine index on the other hand.

Below, the invention is further explained with reference to the examples. In all examples, the bromine index to ASTM D-1492, the acid wash color to ASTM D-848 and the Hazen color index to ASTM D-1209 are listed.

Initially a benzene-rich reformed cut from a catalytic reforming process was subjected to an extractive distillation according to the prior art or the known process referred to above. The product utilized for the extractive distillation showed a relatively high olefin content which increased with the catalytic operating time of the reforming catalyst (see Table 1). After the extractive distillation, the benzene product had a non-aromatics content of <1000 ppm, a bromine index of <20 and an acid wash color, always exceeding 1. It was established that the high acid wash color of the benzene product was already caused by traces of olefins of in particular the group $C_6$-cyclodiene (in particular methyl-1, 3-cyclopentadiene bp: 73° C. and 1,3-cyclohexadiene bp: 81.5° C.) or $C_6$-diolefin and $C_6$-triolefin (in particular methyl-1,3-pentadiene bp: 76° C. or 1,3,5-hexatriene bp: 77.6° C. or 2,6-hexadiene bp: 80° C.). As the boiling point of these olefins is close to the boiling point of benzene, they are difficult to separate from benzene. It was established that even traces of particularly methyl-1,3-cyclopentadiene (MCPDEN) cause a high acid wash color. As an example, 5 ppm MCPDEN were added to a pure benzene with an acid wash color of <1 through which the acid wash color was increased to 2. The following table shows the benzene and MCPDEN content with regards to the extractive distillation and in dependence on the catalyst operating time of the reforming catalyst. The weight ratio of the selective solvent/hydrocarbon was 2.4 for the extract distillation. Hereafter, utilization product refers to the product supplied for the extract distillation and benzene product refers to the product after extract distillation.

TABLE 1

| | | | | |
|---|---|---|---|---|
| Catalyst operating time | h | 100 | 1000 | 1500 |
| benzene in utilizing product | % by weight | 60 | 58 | 61 |
| MCPDEN in utilized product | ppm | 35 | 83 | 900 |
| MCPDEN in benzene product | ppm | 15 | 25 | 139 |

Table 1 shows that the benzene product still contains a relatively high MCPDEN content after extractive distillation, causing the high acid wash color. The benzene product was then cleaned with bleaching earth at temperatures of 160° C. and 200° C. The product of this bleaching earth treatment showed a bromine index of 120, an acid wash color of <14 and a Hazen color index of 380. MCPDEN and other $C_6$-diene were fully converted. Next, a distillation of the product from the bleaching earth treatment was required. The pure benzene from the distillation showed a bromine index of 4, an acid wash color of <1 and a Hazen color index of <3. The latter treatment processes are, however, extremely complex and expensive.

In the following four examples, a selective hydrogenation was carried out before the extract distillation stage according to the present process to selectively hydrogenate olefins and to prevent the conversion of aromatics into saturated hydrocarbons.

EXAMPLE 1

For this example, a reformed cut with a maximum benzene content, generated by a catalytic reforming process was used, showing 65 ppm toluene, a bromine index of 3000 and a MCPDEN content of 120 ppm. In table 2, the test conditions and measured results for example 1a are listed, which used no selective hydrogenation but only extractive distillation. In examples 1b to 1d, selective hydrogenation was combined with extractive distillation according to the inventive procedure. As catalyst for the selective hydrogenation, nickel on aluminum oxide was used as carrier material for all three examples. The selective hydrogenation in 1b to 1d was carried out in such a way that always only 0.96% of the used benzene was hydrogenated to cyclohexane. The extractive distillation (ED) used N-formyl morpholine as solvent in all examples 1a to 1d and a theoretic ED column distillation stage index of 50. The solvent/hc utilization ratio listed in the table under the conditions of the extract distillation refers to the weight ratio of selective solvents to utilized hydrocarbon in the extract distillation column. The heat requirement of the distillation column refers to the heat requirement of the distillation unit or distillation column 9 following the extract distillation column and separating the pure benzene from the selective solvent. The heat requirement in this table and in the following tables 3 and 4 is stated in kJ/kg of generated benzene.

TABLE 2

| Example | | 1a | 1b | 1c | 1d |
|---|---|---|---|---|---|
| Selective hydrogenationa | | no | yes | yes | yes |
| Conditions of extract distillation (ED): | | | | | |
| Solvent/hc utilization ratio | kg/kg | 2.3 | 2.7 | 2.3 | 2 |
| Heat requirement of ED column | kJ/kg | 712 | 833 | 708 | 649 |
| Heat requirement of distillation column | kJ/kg | 996 | 984 | 988 | 963 |
| Utilized product for ED | | | | | |
| Benzene content | % by weight | 66.5 | 66.1 | 66.1 | 66.1 |
| Toluene content | ppm | 65 | 65 | 65 | 65 |
| MCPDEN content | ppm | 120 | <1 | <1 | <1 |
| Bromine index | mg $Br_2$/100 g | 3000 | 330 | 330 | 330 |
| Benzene product from ED: | | | | | |
| Benzene content | % by weight | — | each | >99.96 | — |
| Toluene content | ppm | 140 | 130 | 125 | 112 |

TABLE 2-continued

| Example | | 1a | 1b | 1c | 1d |
|---|---|---|---|---|---|
| MCPDEN content | ppm | 41 | <1 | <1 | <1 |
| Bromine index | mg $Br_2$/100 g | 32 | 1 | 3 | 6 |
| Acid wash color | | 7 | <1 | <1 | <1 |
| Hazen color index | | <3 | <3 | <3 | <3 |

The values in Table 2 show that with a selective hydrogenation, the bromine index of the reforming cut was reduced to 330. Furthermore the selective hydrogenation reduces the $C_6$-diolefin content to non-traceable concentration levels. As an example, the table lists the MCPDEN content which was reduced to <1 ppm. The values for the benzene product from the extract distillation show that in example 1a, without selective hydrogenation, an unfavorably high bromine index and an unfavorably high acid wash color was measured while in examples 1b to 1d, using selective hydrogenation, the bromine index stayed <10 and the acid wash color is <1 and the thus generated pure benzene fulfills all requirements. A comparison of the examples 1b to 1d shows that even at a solvent/hydrocarbon (hc) utilization ratio of 2.0, pure benzene fulfilling the required values, can still be generated. A lower utilization ratio means a higher throughput with the same column dimension and lower specific heat requirement in the extract distillation and distillation column.

EXAMPLE 2

For this example, a reformed cut corresponding to embodiment example 1 was used. Palladium on aluminum oxide as carrier material was used as catalyst for the selective hydrogenation. The selective hydrogenation was in this instance milder than in example 1 so that only approx. 0.29% of the benzene was hydrogenated to cyclohexane. The hydrogenated utilization product for the extract distillation showed a bromine index of 1,730 and a MCPDEN content of 4 ppm. The extract distillation in all examples 2a to 2d used N-formyl morpholine as selective solvent and a theoretical distillation stage index of the extract distillation column of 50.

TABLE 3

| Example | | 2a | 2b | 2c | 2d |
|---|---|---|---|---|---|
| Selective hydrogenation | | no | yes | yes | yes |
| Conditions of extract distillation (ED): | | | | | |
| Solvent/hc utilization ratio | kg/kg | 2.7 | 2.7 | 2.4 | 2 |
| Heat requirement of ED column | kJ/kg | 735 | 729 | 657 | 544 |
| Heat requirement of distillation column | kJ/kg | 1177 | 1181 | 1168 | 1093 |
| Utilized product for ED | | | | | |
| Benzene content | % by weight | 70.3 | 70.1 | 70.1 | 70.1 |
| Toluene content | ppm | 101 | 93 | 93 | 93 |
| MCPDEN content | ppm | 135 | 4 | 4 | 4 |
| Bromine index | mg $Br_2$/100 g | 3260 | 1730 | 1730 | 1730 |
| Benzene product from ED: | | | | | |

TABLE 3-continued

| Example | | 2a | 2b | 2c | 2d |
|---|---|---|---|---|---|
| Benzene content | % by weight | >99.96 | >99.96 | >99.96 | >99.96 |
| Toluene content | ppm | 98 | 103 | 98 | 110 |
| MCPDEN content | ppm | 56 | 2 | 3 | 2 |
| Bromine index | mg $Br_2$/100 g | 43 | 8 | 18 | 56 |
| Acid wash color | | 6 | <1 | <1 | 2 |
| Hazen color index | | <3 | <3 | <3 | <3 |

A comparison of examples 2b to 2d in table 3 shows that due to the low or milder hydrogenation compared to embodiment example 1 and a lower solvent/hydrocarbon (hc) utilization ratio of 2.0, less satisfactory bromine index and acid wash color values were generated. A comparison of the embodiment examples 1 and 2, in particular with regards to examples 1b and 2b showed, however, that by adjusting the hydrogenation conditions or the solvent/hc utilization ratio, the process can be optimized to the desired conditions.

EXAMPLE 3

Within the context of this example, the removal of benzene from reformed gasoline with the generation of pure benzene was carried out. A reformed gasoline with a distillation end point of 165° C. was initially fractionally distilled. The overhead product of the distillation contained 98% of the used benzene. Table 4 shows the example 3a, in which no selective hydrogenation was used and the examples 3b and 3c in which selective hydrogenation with a nickel catalyst on aluminum oxide took place. The selective hydrogenation was carried out in such a way that the benzene loss was approx. 0.89%. In the extract distillation, N-formyl morpholine was used as selective solvent in all three examples 3a to 3c as well as a theoretic distillation stage index of the extractive distillation column of 48.

TABLE 4

| Example | | 3a | 3b | 3c |
|---|---|---|---|---|
| Selective hydrogenation | | no | yes | yes |
| Conditions of extract distillation (ED): | | | | |
| Solvent/hc utilization ratio | kg/kg | 2.3 | 2.3 | 1.5 |
| Heat requirement of ED column | kJ/kg | 4985 | 5006 | 3089 |
| Heat requirement of distillation column | kJ/kg | 1473 | 1498 | 926 |
| Utilized product for ED | | | | |
| Benzene content | % by weight | 17.3 | 27.1 | 17.1 |
| Toluene content | ppm | 350 | 304 | 304 |
| MCPDEN content | ppm | 44 | <1 | <1 |
| Bromine index | mg $Br_2$/100 g | 5060 | 650 | 650 |
| Benzene product from ED: | | | | |
| Benzene content | % by weight | >99.7 | >99.7 | >99.7 |
| Toluene content | ppm | 0.195 | 0.183 | 0.176 |
| MCPDEN content | ppm | 20 | <1 | <1 |
| Bromine index | mg $Br_2$/100 g | 25 | <5 | <16 |
| Acid wash color | | 5 | <1 | <1 |
| Hazen color index | | <3 | <3 | <3 |

The example 3a shows that without a selective hydrogenation unsatisfactory bromine index and acid wash color values in the benzene product were still achieved. A comparison of the examples 3b and 3c shows that in the selective hydrogenation conditions (benzene loss 0.89%) satisfactory bromine index and acid wash color values can still be achieved at a solvent/hc utilization ratio of 1.5. In this respect, this example is an example for the optimization for the process according to the invention, mentioned above with reference to FIG. 2. In example 3c a satisfactory result with regards to the bromine index and acid wash color is achieved with an extremely low solvent/hc utilization ratio and consequently a low energy requirement on one hand and a relatively low benzene loss on the other hand.

EXAMPLE 4

For this example, a reformed cut with the aromatics benzene, toluene, ethylbenzene and xylene was used and a liquid—liquid extraction was carried out with the reformed cut. As a selective solvent a mixture of N-formyl morpholine/water (95/5) was used for all three examples 4a to 4c as well as a theoretical distillation stage index of the liquid—liquid extractor of 50. As catalyst for the selective hydrogenation for examples 4b and 4c, nickel on aluminum oxide was used and the selective hydrogenation was carried out in such a way that the benzene loss from hydrogenation to cyclohexane was 1%. The specific heat consumption is specified in table 5 in kJ/kg aromatics products.

TABLE 5

| Example | | 4a | 4b | 4c |
|---|---|---|---|---|
| Selective hydrogenation | | no | yes | yes |
| Conditions of liquid-liquid extraction (FFE) | | | | |
| Solvent/hc utilization ratio | kg/kg | 3 | 3 | 3 |
| Heat requirement of ED column | kJ/kg | 1873 | 1690 | 1868 |
| BTX utilized product for FFE | | | | |
| Benzene content | % by weight | 7 | 7 | 7 |
| Toluene content | ppm | 19.3 | 19.2 | 19.2 |
| Ethylbenzene/xylene content | % by weight | 20.5 | 20.4 | 20.4 |
| MCPDEN content | ppm | 38 | <1 | <1 |
| Bromine index | mg $Br_2$/100 g | 5280 | 510 | 510 |
| Benzene product from FFE | | | | |
| Benzene content | % by weight | >99.96 | >99.96 | >99.96 |
| Toluene content | ppm | 145 | 152 | 143 |
| Ethylbenzene/xylene content | ppm | — | — | — |
| MCPDEN content | ppm | 125 | <1 | <1 |
| Bromine index | mg $Br_2$/100 g | 47 | 6 | 2 |
| Acid wash color | | >14 | <1 | <1 |
| Hazen color index | | <3 | <3 | <3 |

As part of the liquid—liquid extraction, the aromatics benzene, toluene, ethylbenzene and xylene were separated with selective solvents. From the aromatic product generated by the extraction, pure benzene was distilled. Example 4a shows that without selective hydrogenation the pure benzene has an unfavorably high bromine index and acid wash color. An additional preceding selective hydrogenation, however, achieves optimum results.

What is claimed is:

1. A process for generating pure benzene from a reformed gasoline cut which contains benzene as a principal aromatic compound and which contains olefins, diolefins including methyl-1,3-cyclopentadiene, and triolefins, which consists essentially of the steps of:

(a) selectively and completely hydrogenating in a single step the diolefins including methyl-1,3-cyclopentadiene and triolefins in the reformed gasoline to obtain a mixture of hydrogenated, non-aromatic compounds and aromatic compounds wherein the amount of the benzene undergoing hydrogenation is about 0.29% to 1% and the bromine index of the mixture is higher than 330 mg Br/100 g; and (b) following step (a), separating the aromatic compounds from the hydrogenated, non-aromatic compounds in the mixture formed during step (a) by either extractive distillation, liquid—liquid extraction or both to obtain the pure benzene having a Bromine index of less than 20 mg $Br_2$/100 g and a content of methyl-1,3-cyclopentadiene of less than 1 ppm.

2. The process defined in claim 1 wherein according to step (a) the selective hydrogenation takes place in the presence of a hydrogenation catalyst.

3. The process defined in claim 2 wherein the hydrogenation catalyst is nickel on a carrier material.

4. The process defined in claim 2 wherein the hydrogenation catalyst is palladium on a carrier material.

5. The process defined in claim 1 wherein according to step (b) the extractive distillation or the liquid/liquid extraction is carried out with a solvent which selectively dissolves the benzene.

6. The process defined in claim 5 wherein the solvent which selectively dissolves the benzene is selected from the group consisting of N-formyl-morpholine, N-methyl-pyrrolidone, sulfolane, ethylene glycol, and ethylene glycol monoalkyl ether or dialkyl ether.

7. The process defined in claim 5 wherein the solvent which selectively dissolves the benzene is selected from the group consisting of an N-substituted-morpholine with 1 to 8 carbon atoms in the N-substituent.

8. The process defined in claim 5 wherein the solvent which selectively dissolves the benzene is selected from the group consisting of an alkanediol with 2 to 5 carbon atoms and a monoalkyl or dialkyl ether of said alkanediol.

9. The process defined in claim 5 following step (b) which further comprises the step of separating the pure benzene dissolved in the solvent from the solvent by distillation.

* * * * *